US005311731A

United States Patent [19]

Stahlecker et al.

[11] Patent Number: 5,311,731

[45] Date of Patent: May 17, 1994

[54] SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 895,031

[22] Filed: Jun. 8, 1992

[30] Foreign Application Priority Data

Jun. 8, 1991 [DE] Fed. Rep. of Germany ..... 4118957

[51] Int. Cl.[5] ..... D01H 13/04

[52] U.S. Cl. ..... 57/90; 57/315

[58] Field of Search ..... 57/90, 315

[56] References Cited

U.S. PATENT DOCUMENTS

| | | | |
|---|---|---|---|
| 2,896,269 | 7/1959 | Gardella et al. | 57/315 X |
| 3,312,050 | 4/1967 | Noguera | 57/90 |
| 3,469,385 | 9/1969 | Tsuzuki | 57/90 X |
| 3,844,098 | 10/1974 | Plate et al. | 57/315 |
| 5,085,046 | 2/1992 | Fehrer | 57/315 |
| 5,220,776 | 6/1993 | Stahlecker | 57/90 |

FOREIGN PATENT DOCUMENTS

| | | | |
|---|---|---|---|
| 817572 | 10/1951 | Fed. Rep. of Germany . | |
| 1179840 | 10/1964 | Fed. Rep. of Germany | 57/90 |
| 94625 | 5/1985 | Japan | 57/90 |
| 1015780 | 1/1966 | United Kingdom . | |

*Primary Examiner*—Joseph J. Hail, III

*Attorney, Agent, or Firm*—Evenson, McKeown, Edwards & Lenahan

[57] ABSTRACT

In the case of a spinning machine having several spinning stations for spinning slivers into yarns which were fed in cans, conveyor belts are provided which guide the slivers between the cans and the spinning stations. The cans each contain several slivers, a joint conveyor belt being assigned to at least the slivers of one can.

17 Claims, 4 Drawing Sheets

Fig. 6
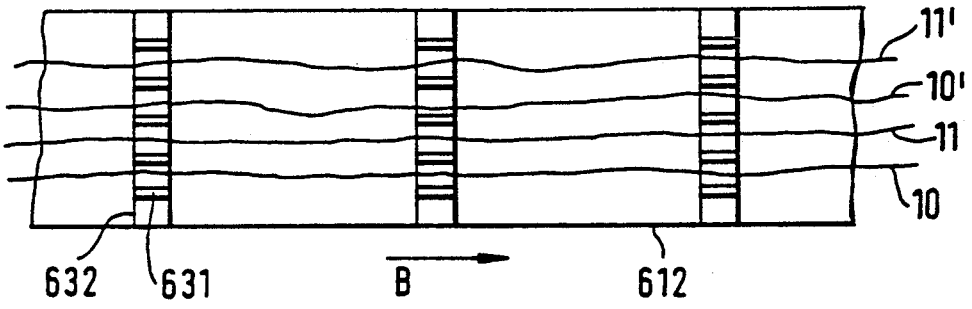
Fig. 7
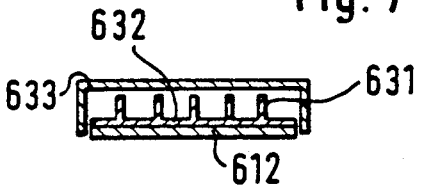
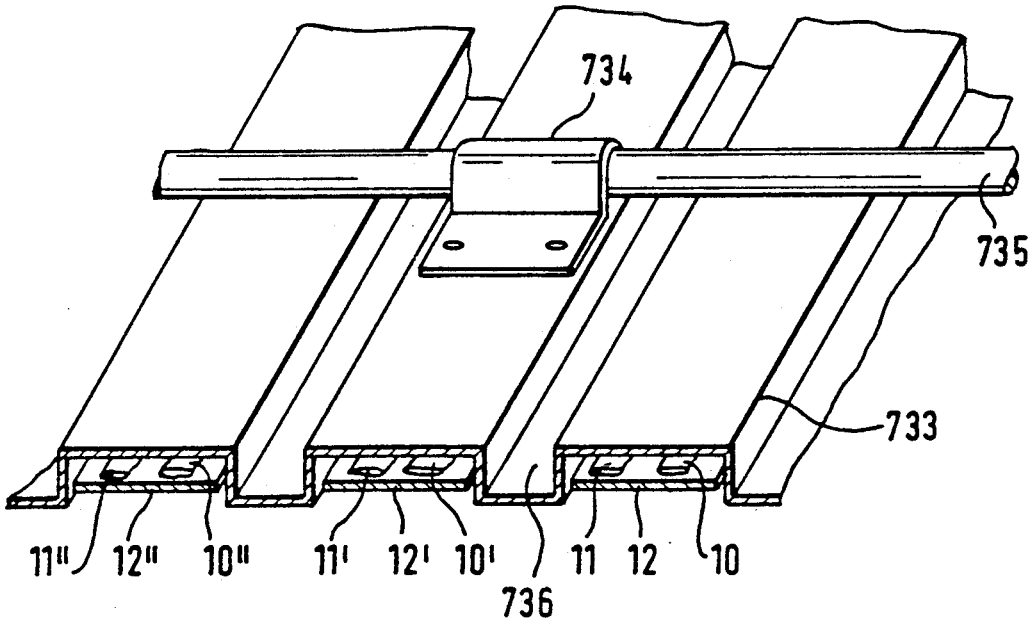
Fig. 8

SPINNING MACHINE

BACKGROUND AND SUMMARY OF THE INVENTION

The present invention relates to a spinning machine having several spinning stations, with depositing sites for cans containing the sliver to be spun and with conveying devices for conveying the slivers from the cans to the spinning stations.

A ring spinning machine of the initially mentioned type is known (GB Patent 10 15 780) in the case of which four rows of cans are deposited on each side of the machine while leaving an aisle. Each can is assigned to a spinning station and contains a sliver. The conveying devices each comprise deflecting rollers arranged above the cans and connecting conveyor belts, of which two conveyor belts respectively receive a sliver between one another in a clamping manner. The conveyor belts start between the rows of cans and first lead downward, then through the floor, to the spinning machine, and from there diagonally upward to the pair of feeding rollers of a drafting unit.

It is also known (German Patent 817 572) to provide a platform in the machine center above the driving devices on which cans of normal dimensions are arranged in two rows. Each of these cans contains four or more slivers which are fed to the drafting units by way of deflecting rollers arranged above the cans and the drafting units of the spinning stations.

It is an object of the invention to provide a spinning machine of the initially mentioned type which requires as little space as possible and in which the conveying devices may be designed to be simple and reasonable in price but operate in such a manner that also fine slivers of approximately Nm 0.3 to approximately Nm 0.8 may be conveyed without the danger of drafting during the transport.

This object is achieved in that the cans, which have a diameter of at least 400 mm, are designed to receive at least two slivers, and in that a joint conveying device, which leads to adjacent spinning stations and comprises a conveyor belt conveying these slivers side-by-side, is assigned to each can for the slivers contained in it.

Because of the fact that at least two slivers are deposited in a joint can, the space requirement can already be reduced. Because of the use of only one conveying device for these slivers, the manufacturing expenditures can be reduced and the space requirement can be further reduced. Despite the fact that at least two slivers are contained in a can, the diameter of the cans which is larger in comparison to drafting cans results in a long running time before an exchange of cans becomes necessary.

In a development of the invention, a joint conveying device is provided for the slivers of two cans standing in a row next to one another, these cans each containing at least two slivers. As a result, it is possible, when, for example, two slivers are contained in each can and when the spinning machine has a division of 75 mm (distance between the spindles of adjacent spinning stations), to provide cans which have a diameter of approximately 440 mm if these are deposited in three rows extending in the longitudinal direction of the machine.

In a further development of the invention, it is provided that the conveying devices each have a conveying section which starts above the cans and leads to the spinning machine and a conveying section which leads downward to the spinning stations. As a result, the sliver transport takes place along relatively short paths so that the conveying devices may be kept correspondingly simple.

In a further development of the invention, it is provided that the conveyor belt of each conveying device extends at least along the first conveying section. Preferably, the same conveyor belt may also form the second conveying section. However, it is also contemplated to constructively simplify the second conveying section and design it, for example, as a slide.

In a further development of the invention, it is provided that the conveyor belts of the conveying device are equipped with devices for keeping the slivers separate. As a result, it is ensured that clear conditions with respect to the guiding of the slivers are created in the area of the transport devices.

In a further development of the invention, it is provided that devices for shielding against air currents are assigned to the conveyor belts. This ensures that particularly air currents directed in the longitudinal direction of the machine cannot have any disadvantageous effect on the transport of the slivers.

In a further development of the invention, guiding devices are provided for determining the entering point of the slivers to the conveyor belts. As a result, perfect entering conditions are ensured by means of which the slivers are taken out of the cans.

Other objects, advantages and novel features of the present invention will become apparent from the following detailed description of the invention when considered in conjunction with the accompanying drawings.

BRIEF DESCRIPTION OF THE DRAWINGS

FIG. 6 is a top view of a conveyor belt for four slivers provided with guiding devices according to a preferred embodiment of the invention;

FIG. 7 is a sectional view of the conveyor belt of FIG. 6 with an additional covering; and FIG. 8 is a perspective representation of three conveyor belts guiding two slivers respectively, for which a joint covering is provided, according to another preferred embodiment of the invention.

DETAILED DESCRIPTION OF THE DRAWINGS

Figure 1:
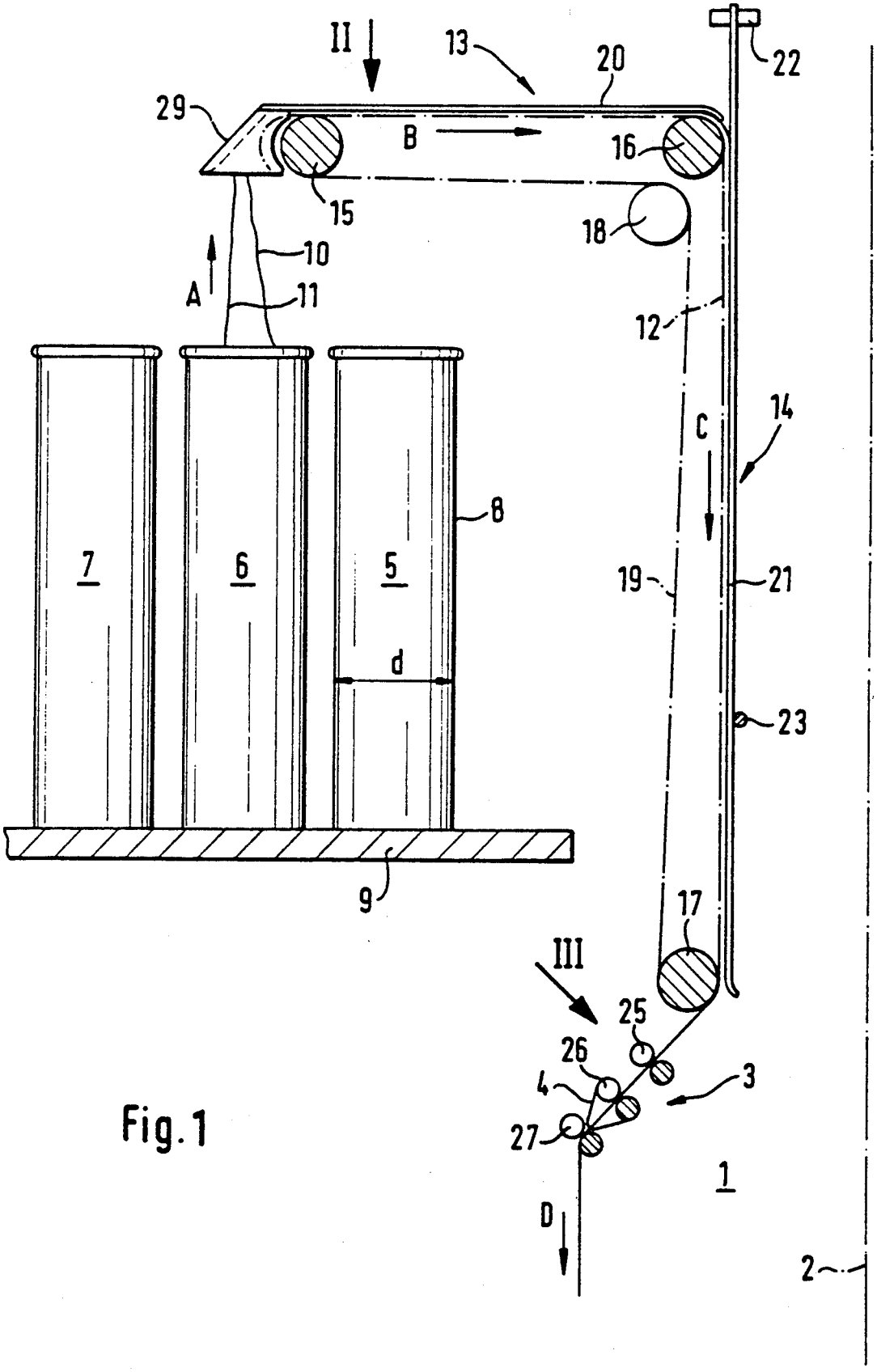
FIG. 1 is a schematic representation of a partial cross-sectional view of a spinning machine constructed according to a preferred embodiment of the invention.

The spinning machine 1, which is only outlined in FIG. 1, is constructed symmetrically with respect to its longitudinal center plane 2 and, on both sides of the machine, has a plurality of spinning stations 3 arranged next to one another. In the case of a ring spinning machine, these may be 600 spinning stations for each side of the machine. Of the spinning stations 3, only one drafting unit 4 respectively is shown which is constructed as a three-cylinder drafting unit.

The sliver material to be spun is fed to the drafting units 4 in the form of slivers 10, 11 which is fed in a size of from Nm 0.3 to Nm 0.8.

The slivers 10, 11 are fed by means of cans 8 which are deposited on a platform 9 in a slightly elevated manner in three rows 5, 6, 7 for each machine side. Each can 8 has a diameter (d) of at least 400 mm and preferably of 440 mm. (For reasons of representation, the cans 8 are drawn with smaller diameters). Each can 8 contains two slivers 10, 11 respectively.

On their path from the cans 8 to the spinning stations 3, the slivers 10, 11 are guided by means of conveying devices in such a manner that no drafting in the slivers 10, 11 occurs along this path, although the slivers 10, 11 are relatively fine and correspondingly sensitive. Each conveying device comprises a conveyor belt 12 which is shown by a dash-dotted line and extends at an angle. It has a first, essentially horizontal conveying section 13 which starts above the cans 8 and leads to the spinning machine 1. There, it is followed by an essentially vertical conveying section 14. The angular course of the conveyor belts 12 is determined by means of deflecting rollers 15, 16, 17. These deflecting rollers 15, 16, 17 are constructed as shafts which extend through in the longitudinal direction of the machine at least along one machine section, in which case one of the deflecting rollers, preferably deflecting roller 17, is constructed as a driving roller which is driven in the area of the machine end. The drive of the conveyor belts 12 is such that the feeding speed of the slivers 10, 11 is approximately by 1.5% slower than the entering speed of the drafting units 4.

By means of another deflecting roller 18, which is arranged in the proximity of the deflecting roller 16, the returning end 19 of the conveyor belts 12 is guided essentially in parallel to the end guiding the slivers 10, 11. This deflecting roller 18 is constructed as a tension roller which is held in a manner not shown in detail and is loaded by means of a resilient tension force.

The slivers 10, 11 are taken from the pertaining cans 8 upwards in the direction of the arrow (A) essentially vertically by means of the conveyor belts 12. They enter into the conveying device by way of sliver guides 29. As a deviation from the representation according to FIG. 1, it is expedient to provide conveyor belts 12 which have different lengths in the area of the horizontal conveying section so that they are in each case arranged at least approximately in the center above the pertaining row 5, 6, 7 of cans 8. The slivers 10, 11 will then extend in the direction of the arrow (B) first essentially horizontally until they reach the deflecting roller 16 serving as the deflecting guide, after which they are guided in the direction of the arrow (C) essentially vertically downward to the drafting units 4. They are then delivered in the area of the lower deflecting roller 17, which is situated in the direct proximity of the drafting units 4, and enter into the drafting units 4. The drafted slivers 10, 11 leave the drafting unit 4 in the direction of the arrow (D) and travel to a twisting element, particularly a ring spindle of a ring spinning machine. Wind-around spindles or air nozzles, or the like may also be used as the twisting element.

Figure 2:
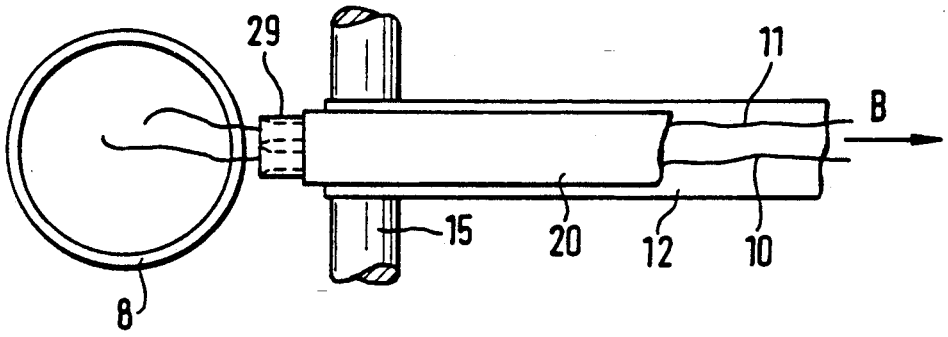
FIG. 2 is a partial top view of FIG. 1 taken in the direction of the arrow II.
Figure 3:
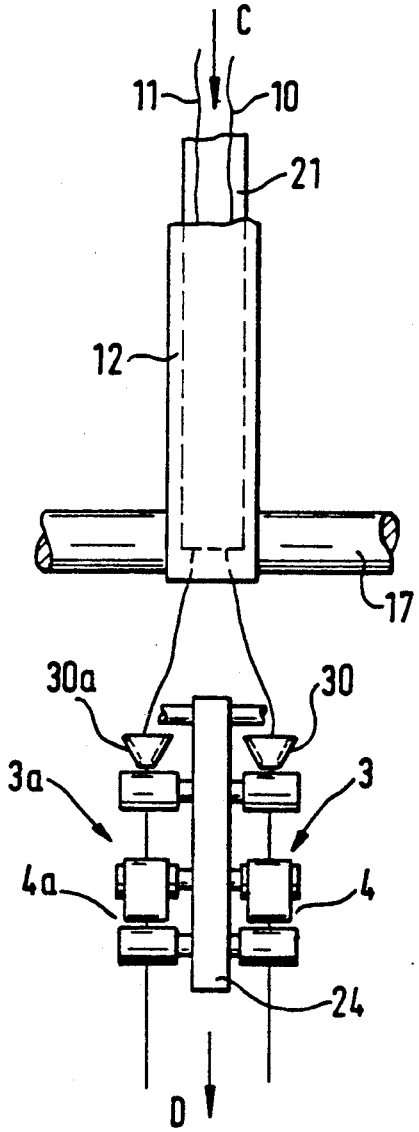
FIG. 3 is a partial view of FIG. 1 taken in the direction of the arrow III.

As illustrated in FIGS. 2 and 3, each of the conveyor belts 12 conveys the two slivers 10, 11 taken from a can 8 which are fed to two adjacent drafting units **4, 4*a* (FIG. 3). These are drafting units 4, 4*a* of adjacent spinning stations 3, 3*a* which have a common load carrier 24 for the pressure rollers 25, 26, 27 constructed as pressure roller twins. Feeding hoppers 30, 30*a* are connected in front of these drafting units 4, 4*a* which receive the slivers 10, 11 after leaving the conveying device and feed them to the drafting units 4, 4*a* at the required distance. Sliding skids 20, 21 are assigned to the conveying sections 13, 14 of the conveyor belts 12 which are placed with smooth surfaces against the conveyor belts 12 with a slight contact pressure force. In this case, the sliding skid 20 of the conveying section 13 expediently rests on the slivers 10, 11 by means of its own weight. The sliver guides 29 are fastened to its forward end so that here an increased contact pressure force exists in a desirable manner in the entering area of the slivers 10, 11. The sliding skid 21 is suspended on a suspending device 22 and, by means of one or several rods 23 extending in the longitudinal direction of the machine, is pressed with a slight force against the pertaining conveyor belt 12**.

Figure 4:
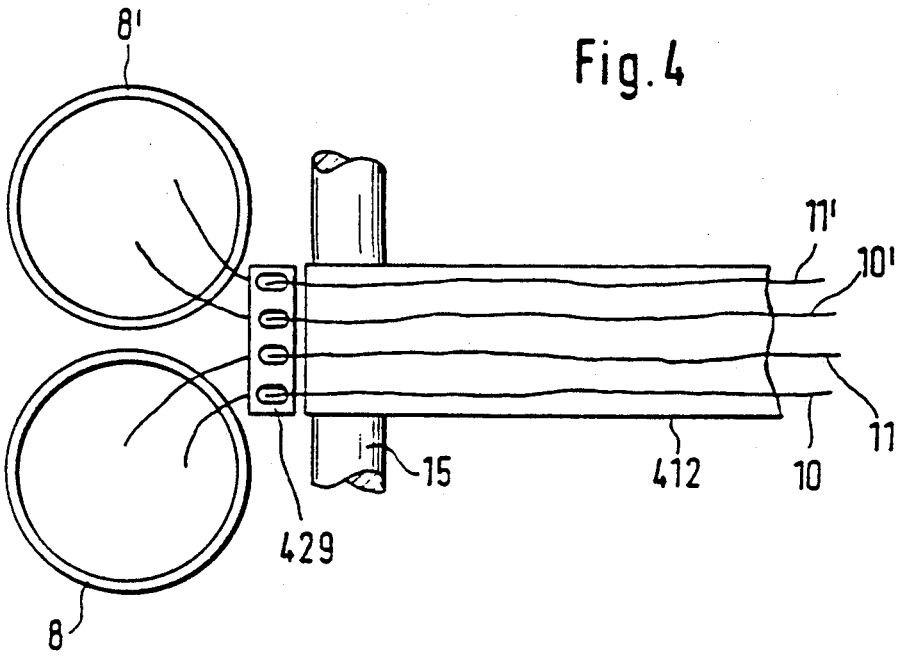
FIG. 4 is a partial top view similar to FIG. 2, in which joint conveying devices are provided for two adjacent cans of a row respectively in another preferred embodiment of the invention.
Figure 5:
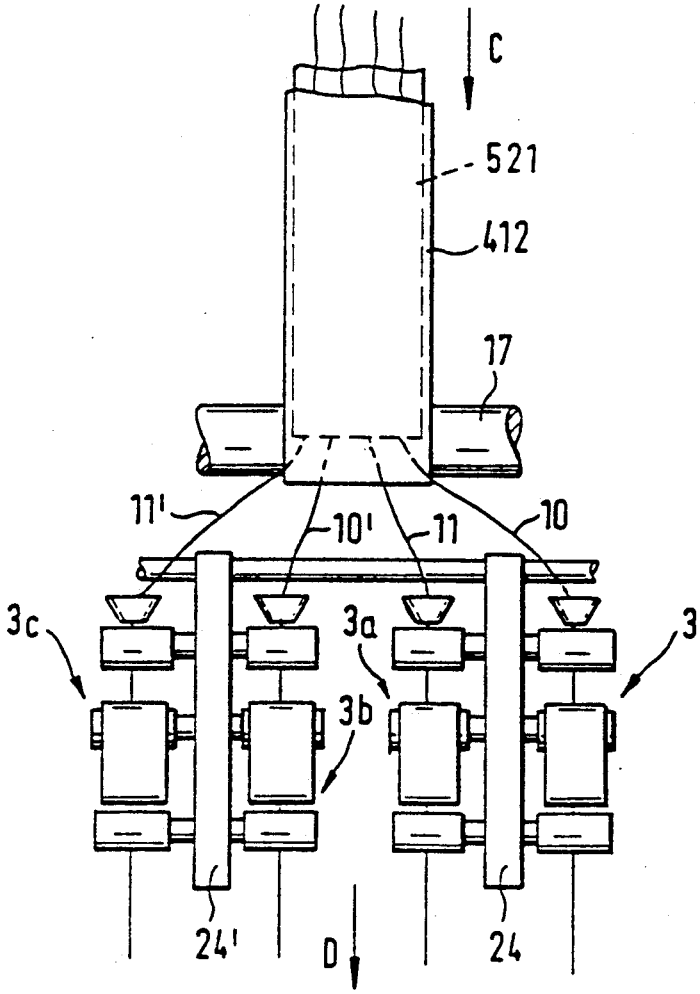
FIG. 5 is a view similar to the view according to FIG. 3 of the embodiment according to FIG. 4.

In the embodiment according to FIGS. 4 and 5, the conveying device has a common conveyor belt 412 which guides a total of four slivers 10, 10', 11, 11' of two adjacent cans 8, 8' to a total of four adjacent spinning stations **3, 3*a*, 3*b*, 3*c*, in which case two of these drafting units 3, 3*a*; 3*b*, 3*c* respectively have joint pressure roller twins with common load carriers 24, 24'. The slivers 10, 10', 11, 11' are taken out of two cans 8, 8' arranged next to one another in a row which each contain two slivers 10, 11; 10', 11'. It is also contemplated to, in a similar manner, take the slivers 10, 11; 10' 11' of two adjacent cans 8 from adjacent rows. The slivers 10, 10', 11, 11' travel to the conveyor belt 412 at the correct distance by way of a sliver guide 429** which correspondingly has four guide openings.

The conveying device according to FIG. 4, in principle, is constructed corresponding to the conveying device according to FIGS. 1 to 3, that is, the conveyor belt 412 takes an angular course. The essentially vertical conveying section is loaded by means of a sliding skid 521. As soon as the slivers 10, 10', 11, 11' leave the area of this sliding skid 521, they are distributed to the individual drafting units of the spinning stations **3, 3*a*, 3*b*, 3*c*** by means of the feeding hoppers.

In the case of this type of a conveying of slivers 10, 10', 11, 11', it is required that the slivers be maintained at a sufficient distance from the lateral edge of the conveyor belt 412, while, in the interior area, they travel relatively closely next to one another and may possibly even be in contact with one another. The distance to the lateral edge is necessary in order to exclude a falling-down. The conveyor belt 412, which conveys a total of four slivers 10, 10', 11, 11' can therefore be produced in a more economical manner than two conveyor belts 12 conveying only two slivers 10, 11 since the edge distance must be maintained only on both sides. The overall width of the conveyor belt 412 may therefore be clearly less than twice the width of the conveyor belt 12 of FIGS. 1 to 3.

In practice, it is useful to protect the slivers 10, 10', 11, 11' not only with respect to a lateral falling-off the conveyor belts, but to also guide them laterally during the transport and therefore keep them at a distance. This may take place, for example, by the fact that the conveyor belts 12, 412 are provided with a profiling in the form of longitudinal ribs. Such a profiling also protects the slivers 10, 11; 10', 11' from being blown off the conveyor belts 12, 412 by air currents.

In the embodiment according to FIG. 6, lateral guides are provided in the from of ledges 632 which are mounted on the top side of the conveyor belt 612 at regular distances, and are, for example, riveted on. These ledges 632 each have guiding ribs 631 which laterally guide the slivers 10, 10', 11, 11'. In the travelling direction of the conveyor belt 612, these guiding ledges 632 are relatively narrow so that they do not impair the flexibility and the deflectability of the conveyor belt 612.

As illustrated in FIG. 7, the fiber-carrying portions of the conveyor belt 612 are, in addition, covered by coverings 633 which have a U-shaped cross-section. As a result, the area of the conveyor belt 612 is protected from any lateral air currents.

For eliminating disturbances and for introducing the slivers 10, 11 during a start-up, it is required to lift at least the sliding skids 20, 633 of the upper first conveying section 13 in order to be able to introduce the starting pieces of the slivers 10, 11, 10', 11'. This may easily be carried out manually by operating personnel because these sliding skids 20, 633 are only loosely placed as a result of their own weight. However, it is also contemplated to provide a lift-off mechanism which simultaneously lifts off the coverings of several adjacent spinning stations and possibly also the coverings of all spinning stations of one side of a machine. Such a mechanism is shown in FIG. 8. The coverings 733 are used for covering several conveyor belts 12, 12', 12'' of one machine side and extend in the longitudinal direction of the machine along a machine section. The coverings have a meandering cross-section, in which case, they dip with groove-shaped indentations 736 into the area between two conveyor belts 12, 12', 12'' respectively and thus cover them laterally. The covering 735 is held by means of a holder 734 on a lift-off rod 735 which can be operated by means of a drive or manually so that the whole covering 736 can be lifted off.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine arrangement comprising:

a plurality of spinning stations, depositing sites for cans containing sliver to be spun, a plurality of cans, with each can containing at least two slivers.

conveying means for simultaneously withdrawing the at least two slivers from each can and conveying the slivers from the cans to the spinning stations, wherein the cans each have a diameter of at least 400 mm and are designed for receiving at least two slivers, and wherein the conveying means include a common conveying device assigned to each can for said at least two slivers contained in each can, said common conveying device leading to adjacent spinning stations, and comprising a conveyor belt for conveying these slivers side-by-side, each conveying device having an inlet, and further comprising guiding elements at the inlet to the conveying devices, the guiding elements guiding the slivers during travel of the slivers into the conveying device and maintaining a separation of the slivers from one another.

2. A spinning machine arrangement according to claim 1, wherein one of the joint conveying devices is provided for the slivers of two cans which stand in a row next to one another, these cans each containing at least two slivers respectively.

3. A spinning machine arrangement according to claim 2, wherein the conveying devices each have a first conveying section starting above the cans and leading to the spinning machine and a second conveying section leading downward to the spinning stations.

4. A spinning machine arrangement according to claim 3, wherein the conveyor belt of each conveying device extends at least along the first conveying section.

5. A spinning machine arrangement according to claim 4, wherein the conveyor belts of the conveying devices are provided with separating devices for keeping the slivers separate.

6. A spinning machine arrangement according to claim 5, comprising shielding devices for shielding the slivers against air currents at the conveyor belts.

7. A spinning machine arrangement according to claim 6, wherein sliding-skid-type coverings are assigned to the conveyor belts.

8. A spinning machine arrangement according to claim 7, wherein the coverings are provided with longitudinal ribs directed toward the inside to the conveyor belts.

9. A spinning machine arrangement according to claim 8, wherein the coverings extend along several conveyor belts arranged in the longitudinal direction of the machine next to one another.

10. A spinning machine arrangement according to claim 1, wherein the conveying devices each have a first conveying section starting above the cans and leading in a direction of the spinning machine and a second conveying section leading downward to the spinning stations.

11. A spinning machine arrangement according to claim 10, wherein the conveyor belt of each conveying device extends at least along the first conveying section.

12. A spinning machine arrangement according to claim 1, wherein the conveyor belts of the conveying devices are provided with separating devices for keeping the slivers separate.

13. A spinning machine arrangement according to claim 12, wherein the conveyor belts are equipped with continuous or subdivided longitudinal ribs.

14. A spinning machine arrangement according to claim 12, wherein sliding-skid-type coverings are assigned to the conveyor belts.

15. A spinning machine arrangement according to claim 14, wherein the coverings are provided with longitudinal ribs directed toward the inside to the conveyor belts.

16. A spinning machine arrangement according to claim 14, wherein the coverings extend along several conveyor belts arranged in the longitudinal direction of the machine next to one another.

17. A spinning machine arrangement according to claim 1, comprising shielding devices for shielding the slivers against air currents at the conveyor belts.

* * * * *